United States Patent [19]

Weiss

[11] 4,239,165

[45] Dec. 16, 1980

[54] UNWINDING STAND FOR A PLURALITY OF ROLLS OF MATERIAL

[75] Inventor: Peter Weiss, Neuss, Fed. Rep. of Germany

[73] Assignee: Jagenberg Werke Aktiengesellschaft, Dusseldorf, Fed. Rep. of Germany

[21] Appl. No.: 33,924

[22] Filed: Apr. 27, 1979

[30] Foreign Application Priority Data

May 2, 1978 [DE] Fed. Rep. of Germany ..... 2819295

[51] Int. Cl.[3] ..... B65H 19/30

[52] U.S. Cl. ..... 242/58.6

[58] Field of Search ..... 242/58.6, 58, 64, 79

[56] References Cited

U.S. PATENT DOCUMENTS

| | | | |
|---|---|---|---|
| 2,549,239 | 4/1951 | Robertson | 242/58.6 |
| 3,176,928 | 4/1965 | Saunders | 242/58.6 |
| 3,321,147 | 5/1967 | Martin | 242/58.6 |

FOREIGN PATENT DOCUMENTS

| | | | |
|---|---|---|---|
| 1206332 | 8/1959 | France | 242/58.6 |
| 493389 | 4/1954 | Italy | 242/58.6 |

*Primary Examiner*—Edward J. McCarthy

*Attorney, Agent, or Firm*—Sprung, Felfe, Horn, Lynch & Kramer

[57] ABSTRACT

An unwinding stand for a plurality of rolls of material has an elevating mechanism for raising the individual rolls of material to the level of bearing brackets mounted on stand columns and disposed on either side of the unwinding stand. The elevating mechanism includes a guide column disposed between the stand columns and an elevating platform with dual outriggers guided on the guide column for the loading of the bearing brackets disposed on both sides of the stand with rolls of material.

6 Claims, 1 Drawing Figure

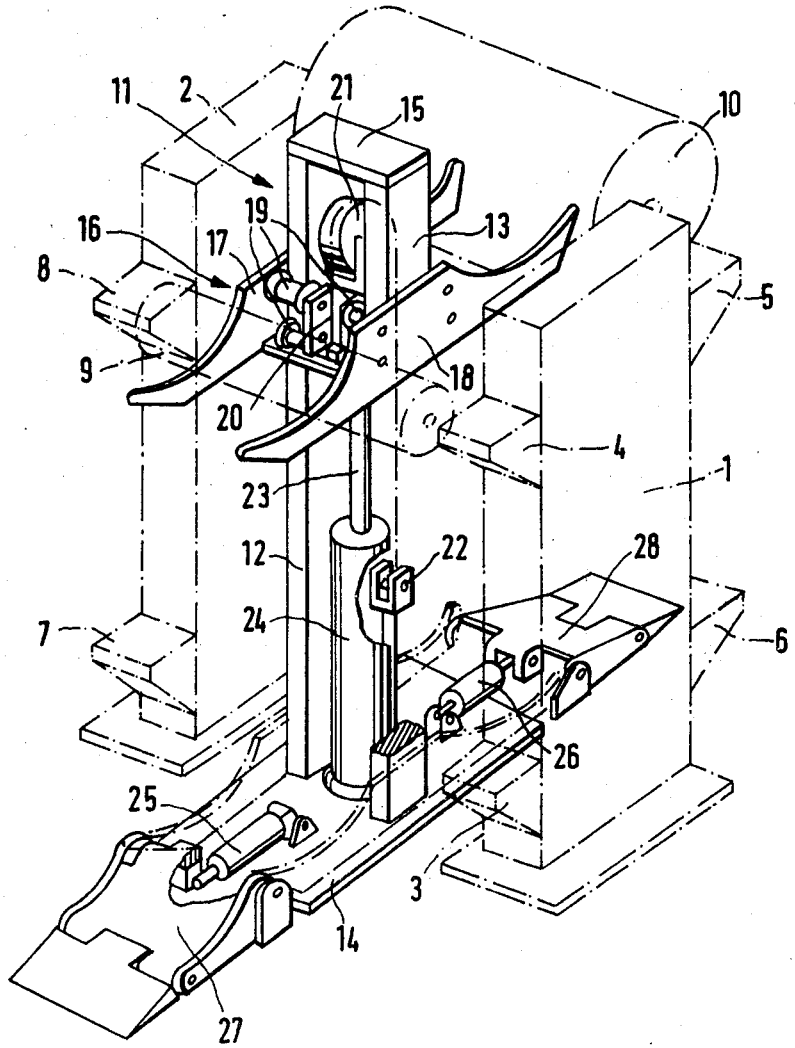
11
2
21
15
10
16
19
13
17
8
5
9
18
20
4
1
23
12
22
28
7
24
6
26
25
3
14
27

UNWINDING STAND FOR A PLURALITY OF ROLLS OF MATERIAL

BACKGROUND OF THE INVENTION

The invention relates to an unwinding stand for a plurality of rolls of material which comprises an elevating mechanism with which the individual rolls of material can be raised to the level of their bearing brackets, disposed on either side of the unwinding stand.

Unwinding stands of this type serve to accommodate several rolls of material at one time from which the webs of material are then unwound parallel to one another. As a rule, the unwinding stands are provided on each side with at least two pairs of bearing brackets. Heretofore the bearing-bracket pairs were loaded with rolls of material by means of either a crane or a fork lift truck. However, there is not always enough space available for a crane or a fork lift truck on sites where it is desired to locate an unwinding stand. Thus there has been a need for being able to load the unwinding stand by means of an elevating mechanism requiring little space.

SUMMARY OF THE INVENTION

The invention has as its object to provide an unwinding stand of the type referred to above with which the individual bearing-bracket pairs can be loaded with rolls of material even when there is not enough room for a crane or a fork lift truck above the unwinding stand or in front and in back of it.

In accordance with the invention, this object is accomplished in that the lifting mechanism comprises a guide column disposed between the columns of the stand and an elevating platform wih dual outriggers guided on the guide column for loading of the bearing-bracket pairs disposed on either side of the stand with rolls of material.

In the invention, the free space between the columns of the stand, which is there anyway, is utilized to accommodate the guide column with the elevating platform. All bearing-bracket pairs on both sides of the stand may be loaded with a single elevating platform if the loading sequence starts with the upper bearing-bracket pairs and ends with the lower bearing-bracket pairs. The unwinding operation is not hindered by the elevating platform with its outriggers since the platform can be lowered to floor level at the end of the loading operation.

The elevating platform is preferably suspended from a hauling means which is run over a pulley adapted to be raised and lowered by a lifting means. With this arrangement, the overall height of stand with lifting means is not greater than the height of the stand alone, and the lifting means need not be recessed in the floor, either; yet the elevating platform is capable of being raised from floor level to the top of the stand. In this arrangement, a cylinder/piston system has proved itself as lifting means.

The guide column advantageously comprises two rails on whose opposite edges the elevating platform is guided by means of rollers or runners. The guide column may be constructed as a frame between whose two rails the lifting means with the hauling means is accommodated.

As loading aids for the outrigger arms, loading ramps are preferably provided which are disposed at floor level, reach under and behind the rolls of material, and are adapted to be swung toward the outrigger arms.

BRIEF DESCRIPTION OF THE DRAWINGS

The invention will now be described in greater detail with reference to a drawing showing a perspective view of an embodiment of the invention.

DETAILED DESCRIPTION OF THE INVENTION

The unwinding stand comprises two stand columns 1 and 2 on whose opposite faces bearing-bracket pairs 3 to 8 are disposed at different levels. The bearing-bracket pairs carry chucking heads (not shown) which fit into the open ends of core tubes on which the individual rolls of material are wound. The drawing shows two rolls of material 9 and 10 which are being raised to the level of the bearing brackets 4, 5 and 8.

Disposed between the two columns 1 and 2 of the stand is a guide column 11, constructed as a frame. The guide column 11 is formed of two rails 12 and 13 which rest on and are fixed to a base plate 14 and which are joined to each other at the top by means of a crossbar 15. An elevating platform 16 is adapted to be moved along the guide column 11. The elevating platform 16 has two dual outriggers 17 and 18 and two sets of rollers 19 which run on the two opposite edges of the rails 12 and 13. The elevating platform 16 is suspended from a hauling means 20, such as a chain or a rope, which passes over a pulley 21 and whose free end is fastened to a holder 22 on the column of the stand. The pulley 21 is carried by the end of the piston rod 23 of a cylinder/piston system 24 resting on the base plate 14 between the rwo rails 12 and 13 of the guide column 11.

Loading ramps 27 and 28 which are hinged to the base plate 14 and are adapted to be positioned by means of cylinder/piston arrangements 25 and 26 serve to load the dual outriggers 17 and 18 (dash-dotted lines) lowered to floor level.

The individual bearing-bracket pairs 3 to 8 are loaded in the following manner:

With the dual outriggers 17 and 18 in the dash-dotted position, a roll of material each is rolled onto the loading ramps 27 and 28, respectively. The cylinder/piston arrangements 25 and 26 are then actuated to roll the rolls of material onto the outriggers 17 and 18. Now the cylinder/piston system 24 can be actuated. The elevating platform 11 bearing the rolls of material 9 and 10 then moves upwardly along the guide column 11. This operation is illustrated in the drawing by the dash-dotted rolls of material 9 and 10 just before the upper bearing-bracket pairs 4, 5 and 8 are reached. When the bearing-bracket pairs 4 and 8 are at the same level as the bearing-bracket pair 5 disposed on the other side and the rolls of material are of different thicknesses, the elevating platform 16 must be raised sufficiently for the smaller-diameter roll of material with its tube core to be at the level of the bearing brackets 4 and 8. After this roll of material 9 has been chucked, the elevating platform is slightly lowered until the tube core of the larger-diameter roll of material 10 is at the level of the bearing-bracket pairs 5. Once this roll of material, too, has been chucked, the elevating platform is again lowered to floor level to permit the next two rolls of material to be loaded onto the elevating platform 16.

The invention thus makes it possible to load the bearing brackets disposed on either side of an unwinding stand without requiring extra space. In particular, the invention permits the unwinding stand to be loaded over its entire height without there being any need for the elevating mechanism to surmount the unwinding stand or to be partly recessed in the floor.

I claim:

1. In an unwinding stand for a plurality of rolls of material having elevating means for raising individual rolls of material to the level of bearing brackets mounted on stand columns and disposed on either side of the unwinding stand, the improvement wherein the elevating means comprises: a guide column disposed between the stand columns; an elevating platform with dual outriggers; and means guiding the elevating platform on said guide column for the loading of the bearing-brackets disposed on both sides of the stand with rolls of material.

2. The unwinding stand according to claim 1, wherein the elevating means further comprises hauling means for the elevating platform, a pulley over which a portion thereof is suspended and lifting means for raising and lowering the platform, pulley and hauling means as a unit.

3. The unwinding stand according to claim 2, wherein the lifting means comprises a cylinder/piston arrangement.

4. The unwinding stand according to claim 2, wherein the guiding means comprises two rails on the guide column and rollers on the elevating platform guided on the opposite edges of the rail.

5. The unwinding stand according to claim 4, wherein the guide column comprises a frame including said two rails and between which the lifting means and the hauling means are disposed.

6. The unwinding stand according to claim 1, further comprising means for loading the dual outriggers comprising loading ramps disposed at floor level which reach under and behind the rolls of material and means for pivoting the ramps toward the outriggers.

* * * * *